United States Patent [19]

Miner

[11] 4,442,737

[45] Apr. 17, 1984

[54] THREAD PROTECTOR WRENCH

[76] Inventor: Robert M. Miner, P.O. Box 373, Casper, Wyo. 92602

[21] Appl. No.: 368,159

[22] Filed: Apr. 14, 1982

[51] Int. Cl.[3] ..... B25B 15/00

[52] U.S. Cl. ..... 81/448

[58] Field of Search ..... 81/442, 448

[56] References Cited

U.S. PATENT DOCUMENTS

| | | | |
|---|---|---|---|
| 2,865,640 | 12/1958 | Watson et al. | 81/448 |
| 3,471,160 | 10/1969 | Sabo . | |
| 3,858,613 | 1/1975 | Musslewhite . | |
| 4,036,261 | 7/1977 | Hauk et al. . | |
| 4,173,988 | 11/1979 | Fowler . | |

*Primary Examiner*—Frederick R. Schmidt
*Assistant Examiner*—J. T. Zatarga
*Attorney, Agent, or Firm*—Laurence R. Brown

[57] ABSTRACT

Removal of a screw-on type of thread protector from a pipe is achieved by this invention with uniformly applied pressure about the entire circumferential surface of the thread protector. Thus an inflatable type grasping urethane boot of a wrench mechanism is positioned circumferentially about and adjacent to the grasping surface of a generally cylindrical screwed-on thread protector before inflation. The boot is connected with a chamber which retains a fluid such as air under pressure and thus is firmly coupled in grasping connection with the thread protector by inflating in place from an air pressure hose for example. After removal of the thread protector, the chamber may be deflated to release it. The wrench is manipulated to rotate the inflated boot by rotation of a shaft co-axially located with the pipe to which the inflation valve may be attached for ready access. Preferably, the boot is supplied with a tread design to give better grasping characteristics.

7 Claims, 5 Drawing Figures

FIG. 1
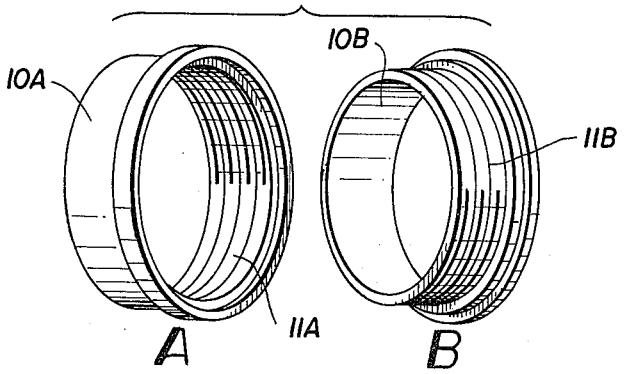
FIG. 2
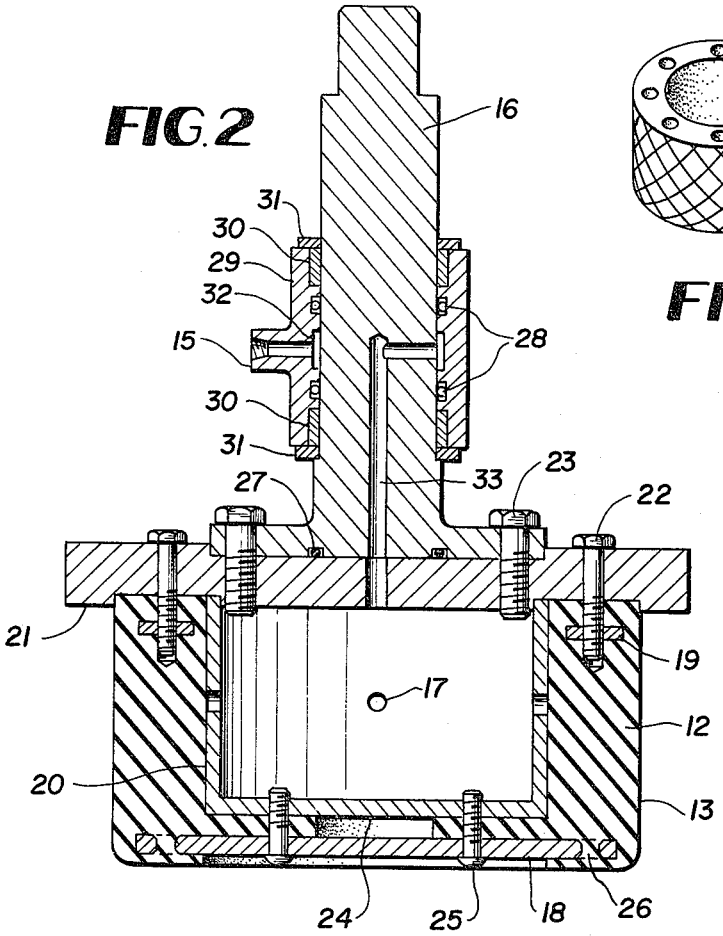
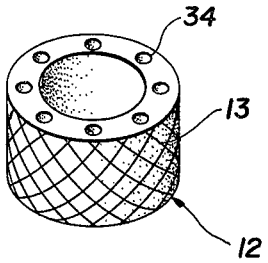
FIG. 3

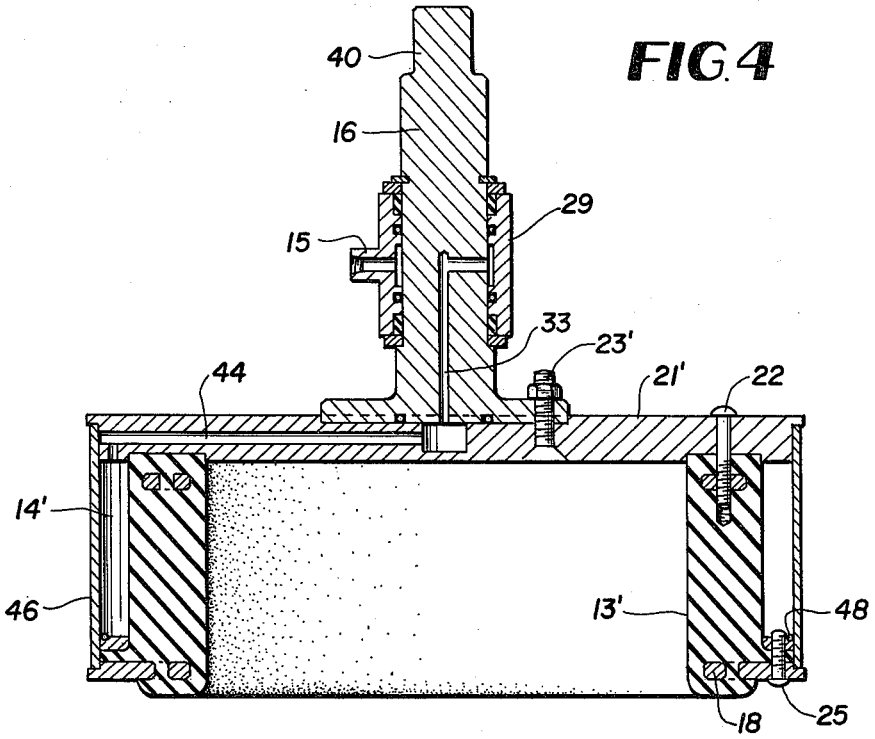
FIG. 4
FIG. 5
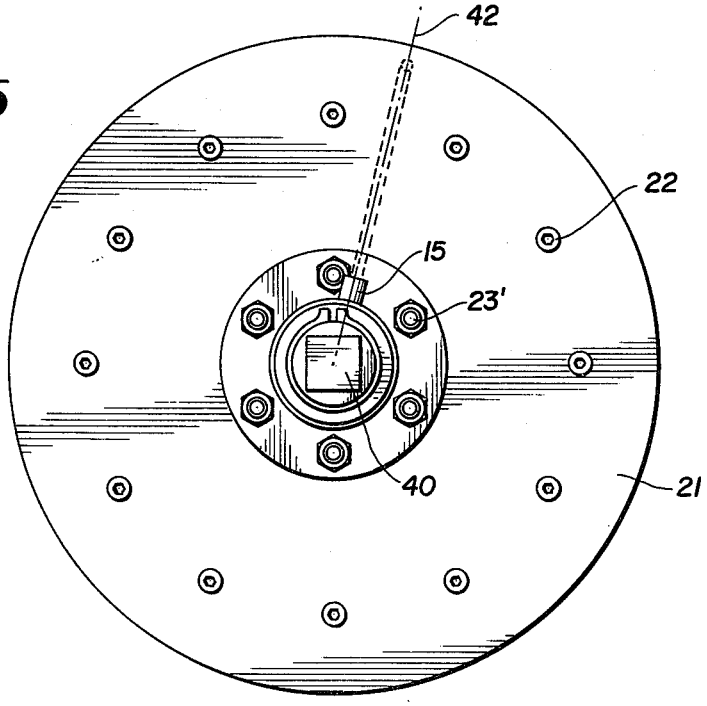

THREAD PROTECTOR WRENCH

TECHNICAL FIELD

This invention relates to wrenches and more particularly it relates to wrenches for removing thread protectors screwed onto threaded pipe sections to protect the threads.

BACKGROUND ART

Pipe threading on pipe sections that undergo handling has routinely been protected by thread protectors of steel or other protective materials screwed on the pipe threading. These must be removed before the pipe is coupled to threaded joints. Particularly in the casing pipes used in oil wells, the threaded pipe is expensive and the threads need protection from damage. In this field usual pipe dimensions are 2⅜ inches to 24 inches outer diameter.

Problems arise in removal of the thread protectors which may become deformed by impact, etc. in pipe handling. There has been no satisfactory wrench to remove the protectors while assuring that the pipe threads are not damaged in removal by slipping of the wrench or by having to use unorthodox methods of removal because of dirty or damaged thread protectors which require considerable removal torque. Also, it is desirable to reuse the thread protectors, thus requiring removal without damage thereto.

Typical of special pipe wrenches for handling threaded pipes is Sabo—U.S. Pat. No. 3,471,160—Oct. 7, 1969 which requires a special wrench shape mating with slots or keys in the pipe, etc. Such wrenches could not handle standard generally cylindrical pipe thread protectors both for external and internal threads.

In order to preclude the problem aforesaid it has required in the past special expensive pneumatically inflatable thread protectors as set forth for example in U.S. Pat. Nos. Fowler—4,173,988—Nov. 13, 1979; Hauk et al.—4,036,261—July 19, 1977; and Musslewhite—3,858,613—Jan. 7, 1975.

It is, however, an objective of this invention to provide special wrenches overcoming the aforegoing problems, where the wrenches can non-destructively remove simple low cost threaded on thread protectors. Other features, objects and advantages will be found throughout the description, drawing and claims.

DISCLOSURE OF THE INVENTION

This invention therefore provides for removal of threaded on pipe thread protectors by a special wrench having a cylindrical resilient grasping member, typically of 50A Durometer urethane, adjacent a mating cylindrical grasping surface of the thread protector. The grasping member is associated with a chamber for retaining and releasing a fluid, such as air, under pressure so that the urethane may be forced into grasping contact with the thread protector with uniform pressure about the circumferential grasping surface. Then the grasping member is rotated about the pipe axis by an axially positioned shaft affixed to the grasping member and chamber for rotating them to remove the thread protector. Wrenches are made for removal of both internal and external thread protectors.

BRIEF DESCRIPTION OF THE DRAWINGS

In the drawing:

FIGS. 1A and 1B are respective perspective views of generally cylindrically shaped thread protectors for mating with external and internal pipe threads;

FIG. 2 is a section view taken along a pipe axis of a thread protector removal wrench embodiment afforded by this invention to remove thread protectors internally disposed in the pipe;

FIG. 3 is a perspective view of a urethane boot thread protector grasping surface having a tread pattern thereon;

FIG. 4 is a section view taken along a pipe axis of a thread protector removal wrench embodiment afforded by this invention to remove thread protectors externally disposed on threads in the outer pipe surface; and FIG. 5 is a plan top view of the wrench embodiment of FIG. 4.

THE PREFERRED EMBODIMENTS

As may be seen from FIG. 1, the screw-on type thread protector is a sleeve generally cylindrical in shape, typically a steel body having threads mated with screw threads of a pipe section (not shown) either on the outer circumference such as shown in FIG. 1A or on the inner circumference as shown in FIG. 1B to prevent damage to the pipe threads during handling. Particularly, if the pipe gets dirty or the thread protector becomes deformed by impact, etc. in handling, it is difficult to remove the thread protector without use of substantial torque. Thus, some sort of tool is necessary that does not in the removal process damage the threads which have been theretofore protected by the protective sleeve.

If a tool such as a pipe wrench is used to grasp the outer grasping surface of the protective sleeve (A), unequal pressure is applied through the circumference tending to deform the sleeve to oblong shape and to compress or even fracture the sleeve if it is difficult to start unthreading. Similar problems exist with an internal wedge type wrench for removing the internally positioned protective sleeve (B). Thus a pipe thread can be damaged in removal of the sleeves by prior art tools.

As will be illustrated by the embodiment seen in FIG. 2, this wrench embodiment, as provided by this invention, will afford uniform pressure about the entire circumference of the interior grasping surface 10B opposite the threaded surface 11B on the inner mounted protective sleeve (B). This is achieved by means of a cylindrical boot grasping member 12 of a resilient material, typically urethane of 50A Durometer hardness, and preferably having its outer circumferential surface 13 with a tread pattern as seen better in FIG. 3. This boot 12 is mounted about a closed chamber 14 for retaining fluid under pressure, preferably air as admitted and released at a conventional valve stem 15 located for ready access on the axial rotary shaft 16 to be positioned coaxially along the pipe axis when in use. Thus, the chamber may be pressurized at typically 100 psi from an air hose (not shown) coupled to a source of pressurized air.

By means of apertures 17 in the chamber 14 walls, the urethane boot 12 is resiliently urged outwardly into firmly grasping connection about its entire circumference with the adjacent thread protector sleeve (not shown). The air pressure will equalize about the circumference between the chamber 14 walls 20 and the urethane boot 12 even with a few radially disposed apertures 17.

The urethane boot 12 has cast thereinto a bottom retainer ring 18 of aluminum and radially located steel ring nuts 19 coaxial with apertures 34. Thus, the boot 12 can be rotatably mounted in unison with a housing comprising top plate 21 and the shaft 16 by means of bolts 22. Because of the resiliency of the urethane the bottom portion is squeezed between the bottom wall 24 of the plenum chamber 14 and the aluminum plate 18 by means of bolts 25. The apertures 26 in the aluminum plate 18 serve to bond the urethane boot 12 to the plate. Shaft 16 is unitarily connected to the housing plate 21 to rotate it by means of bolts 23.

The plenum chamber 14 is made fluid tight to retain its pressure by means of O-ring seals 27, 28. The valve stem 15 is held in place in steel body 29 rotatably mounted in shaft 16 by bronze bushings 30, 31 so that the valve stem 15 may be rotated to an accessible position if necessary. Air (fluid) then passed into ring 32 and down the axial shaft piping 33 into the plenum chamber 14.

It is thus seen that in operation the boot 12 is first inserted inside the pipe to abut the inner thread protective sleeve (B) and fits thereinto with the outer boot grasping surface 13 opposing the inner sleeve grasping surface 10B. Then the wrench plenum chamber is pressurized by means of an air hose at valve stem 15 thereby to press the urethane resilient member surface outwardly to seal the tread surface 13 against the thread protector surface 10B in grasping connection therewith. Thus, the axial shaft 16 may be rotated to unscrew the threads of threaded surface 11B from the interior pipe threads which the sleeve (B) has been protecting. After removal of the thread protector sleeve (B) the valve 15 may be operated to deflate plenum chamber 14 and release the thread protector for further use. The inflatable wrench assembly is then ready for further use.

As seen from FIGS. 4 and 5 the same principal of operation follows for the modified wrench assembly therein adapted to fit over the outside circumference of the thread protector sleeve (A) for protecting threads on the outer pipe circumference. Similar reference characters are used for comparison for corresponding parts, and the primed characters represent similar function in modified form. Note the square shaft portion 40 for rotating the wrench assembly with a standard tool such as a socket or open end wrench. Also note the notation 42 which indicates the valve stem 15 is rotatably mounted.

The modified housing lid 21' has therein an air passageway 44 communicating with the plenum chamber 14 located within outer housing wall 46. Also O-ring 48 is provided to seal the bottom closure portion.

This embodiment works in the same manner except that the urethane boot surface 13' grasps the outer circumferential grasping surface 10A of the sleeve (A) protecting threads on the outer surface of the pipe. The wrench assembly is inflated and rotated in the same manner to unscrew threads 11A from the mating pipe threads.

Having therefore advanced the state of the art and provided novel and useful tooling, those novel features believed descriptive of the spirit and nature of the invention are defined with particularity in the claims.

I claim:

1. A wrench for removing generally cylindrically shaped thread protector members having two generally cylindrical surfaces, namely a grasping surface and a threaded surface, the latter being adapted to screw on the threads at the end of a pipe section, said wrench, comprising in combination, a rotary drive shaft adapted to rotate about the axis of a pipe section having a thread protector screwed thereon to remove the thread protector by unscrewing it, a generally cylindrical resilient boot member coupled to turn with said drive shaft having a cylindrical surface positionable to abut the grasping surface of the thread protector, and a housing engaging said boot member and said shaft to rotate therewith providing about said boot member a chamber for retaining and releasing fluid under pressure adapted with the boot member in place abutting the grasping surface to exert pressure against said boot member thereby to urge the boot member abutting surface into contact with substantially uniform pressure about the entire circumference of the grasping surface of the thread protector.

2. A wrench as defined in claim 1 with an outer cylindrical surface adapted to enter the open end of a pipe section to remove a thread protector threaded upon threads inside the pipe, said outer surface comprising an outer cylindrical surface of said resilient boot member surface for abutting the thread protector surface.

3. A wrench as defined in claim 1 for removing a thread protector threaded upon an outer pipe section surface, wherein said boot has an inner circumferential surface adapted to surround and abut the thread protector grasping surface.

4. A wrench as defined in claim 1 wherein the boot member is urethane with a hardness about 50A Durometer.

5. A wrench as defined in claim 4 wherein the surface of the boot engaging the thread protector has a tread pattern thereon.

6. A wrench as defined in claim 4 wherein said boot member is affixed to said rotary shaft for rotation therewith by means of a plurality of coupling fasteners extending from the urethane boot to engage a metallic member rotatable with said shaft.

7. A wrench as defined in claim 1 including a valve affixed to said drive shaft for coupling to a source of pressure and fluid conveyance means coupling the valve to said chamber.

* * * * *